US006402062B1

(12) United States Patent
Bendig et al.

(10) Patent No.: US 6,402,062 B1
(45) Date of Patent: Jun. 11, 2002

(54) HIGH-PRESSURE SPRAY NOZZLE

(75) Inventors: Lothar Bendig, Pfullingen; Thomas Schenk, Nürtingen, both of (DE)

(73) Assignee: Lechler GmbH + Co. KG, Metzingen (DE)

( * ) Notice: Subject to any disclaimer, the term of this patent is extended or adjusted under 35 U.S.C. 154(b) by 0 days.

(21) Appl. No.: 09/556,625

(22) Filed: Apr. 21, 2000

(30) Foreign Application Priority Data

Apr. 22, 1999 (DE) ..... 199 18 257

(51) Int. Cl.[7] ..... B05B 1/00

(52) U.S. Cl. ..... 239/599; 239/589; 239/597; 239/601

(58) Field of Search ..... 239/589, 591, 239/592, 595, 597, 599, 601

(56) References Cited

U.S. PATENT DOCUMENTS

| | | | | | |
|---|---|---|---|---|---|
| 1,569,448 | A | * | 1/1926 | Banner | 239/599 |
| 2,125,445 | A | * | 8/1938 | Holveck | 239/599 |
| 3,488,006 | A | * | 1/1970 | Gigantino | 239/599 |
| 3,756,511 | A | * | 9/1973 | Shinroku et al. | 239/599 X |
| 4,618,101 | A | * | 10/1986 | Piggott | 239/589 |
| 4,646,977 | A | * | 3/1987 | Iwamura et al. | 239/601 X |
| 5,052,624 | A | * | 10/1991 | Boers et al. | 239/599 X |
| 5,538,188 | A | * | 7/1996 | Simonette | 239/599 |
| 5,878,966 | A | * | 3/1999 | Asakawa et al. | 239/589 X |
| 5,881,958 | A | * | 3/1999 | Asakawa et al. | 239/597 X |
| 5,961,053 | A | * | 10/1999 | Raghavan et al. | 239/599 |

FOREIGN PATENT DOCUMENTS

| | | |
|---|---|---|
| DE | 34 14 880 A1 | 10/1985 |
| EP | 0 792 692 A1 | 9/1997 |
| EP | 0 862 950 A1 | 9/1998 |

* cited by examiner

*Primary Examiner*—Steven J. Ganey
(74) *Attorney, Agent, or Firm*—Crowell & Moring, LLP

(57) ABSTRACT

Known high-pressure spray nozzles tend to develop wear at outlet edges for a flat stream because of fluid emerging at very high pressure. It has already been proposed to provide, on the nozzle bodies, instead of transverse continuous outwardly open groove-shaped cuts, outlet channels with a cross-sectional pattern that expands outward trumpetwise in an elliptical shape or to prevent any contact between the nozzle body and the high-pressure stream at the outlet edge. It is now proposed to provide the outlet channel with an elliptical cross section, with expansion of the cross section exclusively in the direction of the major semiaxis but with no increase in dimension in the direction of the minor semiaxis. In this way, the flat stream to be formed can be guided and held together without wear at an outlet edge. The nozzle can be used as a high-pressure flat stream nozzle for de-scaling.

3 Claims, 2 Drawing Sheets

HIGH-PRESSURE SPRAY NOZZLE

This application claims the priority of German application 199 18 257.4, filed Apr. 22, 1999, the disclosure of which is expressly incorporated by reference herein.

BACKGROUND AND SUMMARY OF THE INVENTION

The present invention relates to a particular high-pressure spray nozzle having a rotationally symmetrical nozzle body with a coaxial supply bore for a fluid to be sprayed. The bore tapers to an elliptical opening which forms the entrance opening for an outlet channel, and the outlet channel terminates in an elliptical outlet opening with a larger cross section located in a flat outlet surface of the nozzle body.

A high-pressure spray nozzle for de-scaling or cleaning rolled metal is known from European publication EP 0 792 692 A1. An outlet channel located downstream from the supply bore expands from its entrance opening to the outlet opening by way of concave walls all the way around with curvatures which must be designed so that the wall in the outlet area does not come in contact with the high-pressure flat stream formed by the spray medium. As a result of this design, in contrast with flat stream nozzles of a different design produced by chip removal to mill a groove in the vicinity of the mouth of the supply bore (see Germany publication DE 34 14 880 A1), no sharp edges that lead to premature wear of the nozzle as a result of the fluid stream emerging under very high pressure are formed in the outlet area of the stream. This is also achieved by having the walls of the outlet channel expand "trumpetwise" toward the mouth or otherwise so that they do not come in contact with the fluid stream in the vicinity of the mouth. One disadvantage of such spray nozzles is that, as a result of the lack of guidance of the high-pressure stream, the flat stream can expand, without guidance, toward the minor semiaxis of the elliptical outlet opening so that the stream pressure that can be produced is reduced.

A high-pressure cleaning nozzle is known from European publication EP 0 862 950 A1 in which a tapered pressure medium supply channel that makes a transition in the form of a hemisphere to an outlet opening is provided. At the outlet end of this high-pressure nozzle, a groove with a circular cross section that runs perpendicularly to the axis of the supply channel and extends transversely over the entire end surface is provided. In the middle of this groove, a depression with an oval shape, with parallel side walls, and with a circular bottom are also provided. This depression cuts the spherical end portion of the supply channel, thus forming a likewise oval outlet opening with edges connecting the parallel side walls which make a stepwise transition to the area of the circular bottom of the depression and then again merge stepwise with the area of the groove passing over the end. Such nozzles do not provide an opening that expands exclusively elliptically and continuously outward. The shape of the stream therefore differs from that of the high-pressure spray nozzle mentioned above. Sharp edges remain that likewise can result in premature wear.

One object of the invention is to design a high-pressure spray nozzle of the type recited at the outset such that wear by the formation of acute angles at the outlet edge is avoided but such that improved bundling of the flat stream takes place at the outlet so that the stream pressure can be increased. To achieve this object, provision is made in a high-pressure spray nozzle of the type recited at the outset that only the areas of the side walls of the outlet channel that abut the major semiaxis of the elliptical outlet opening are expanded in the flow direction while the areas of the outlet channel that abut the minor semiaxis form side walls that run essentially coaxially to the supply bore.

By this measure, the flat stream is prevented from also expanding in the direction of the minor semiaxis in such fashion that it cannot be influenced. The impact area of the flat stream can be sharply delimited so that the stream pressure is also greater than in known high-pressure spray nozzles. The advantage that no acute angles appear on the outlet edge, as is the case in spray nozzles made by chip removal, is retained.

Preferably, the side walls of the outlet channel that abut the major semiaxis are made so that they run essentially parallel to the desired boundary surfaces of the expanding fluid stream. The walls of the outlet channel that lie on the lengthwise extension of the flat stream cross section, therefore, remain as guide surfaces for the latter in contact with the flat stream.

Another feature is that the side walls of the outlet channel that abut the major semiaxis can be partial surfaces of a conical jacket. These side walls then delimit the latter in the lengthwise direction of the flat stream so that the entire high-pressure flat stream, in its entire outer area, is guided as it leaves the nozzle and can thus be kept within limits in the desired fashion. The stream pressure that can be achieved as a result is higher than according to the prior art. Therefore, if such nozzles are used for descaling or for cleaning, their cleaning action is greater.

An embodiment of the invention is shown schematically in the drawings and is described in the following.

DETAILED DESCRIPTION OF THE DRAWING FIGURES

Figure 1:
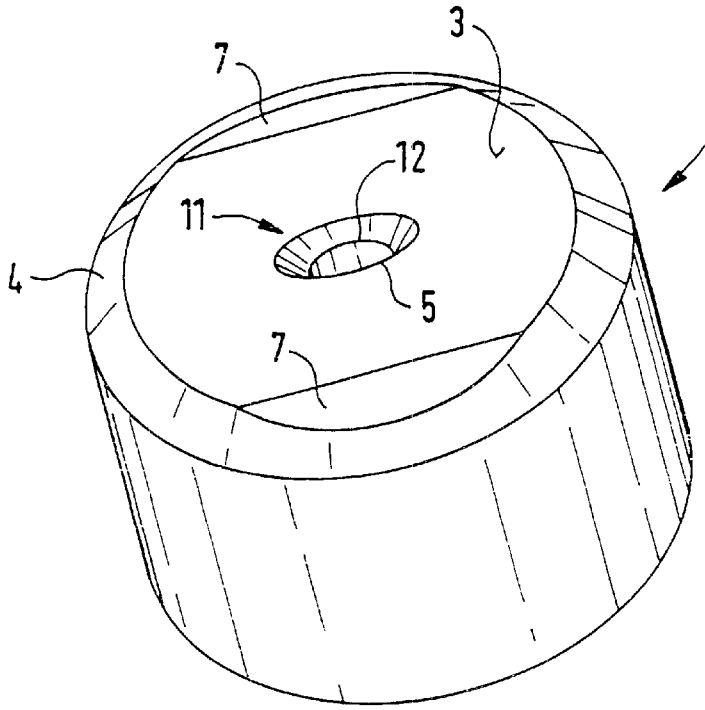
FIG. 1 is a schematic perspective view of the nozzle body of the high-pressure spray nozzle according to the invention.
Figure 2:
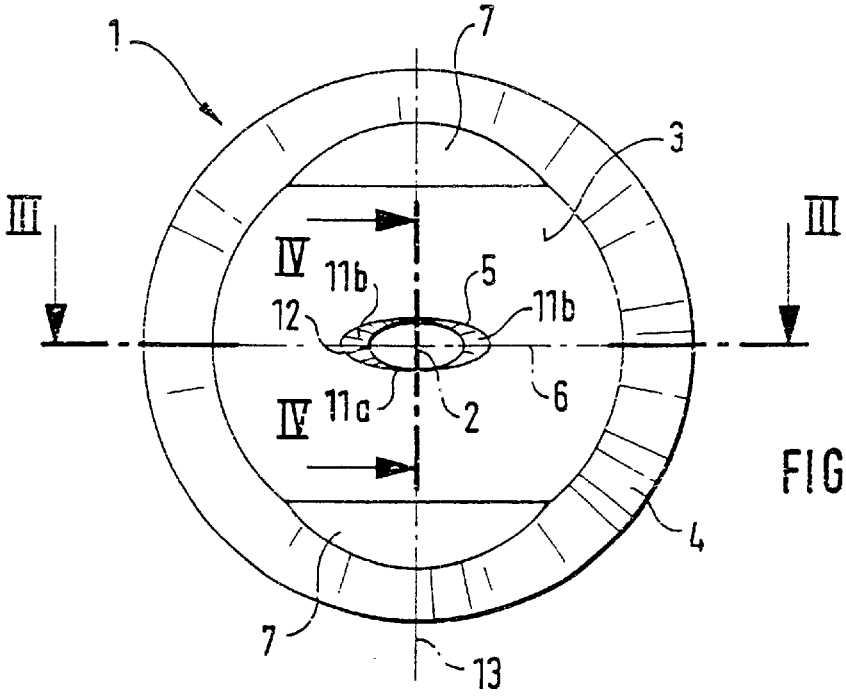
FIG. 2 is a top view of the nozzle body in FIG. 1.

FIGS. 1 and 2 show a cylindrical nozzle body 1 delimited by an end surface 3 that is perpendicular to its axis 2. The surface 3 makes a transition by way of a circular bevel 4 to the cylindrical part of the nozzle body 1. An elliptical outlet opening 5 is provided in the end surface 3 and has a major semiaxis 6. Two sections 7 delimit the end surface 3 from the surrounding bevel 4 by flat surfaces that extend diagonally to the flat area of the circular bevel 4.

Figure 3:
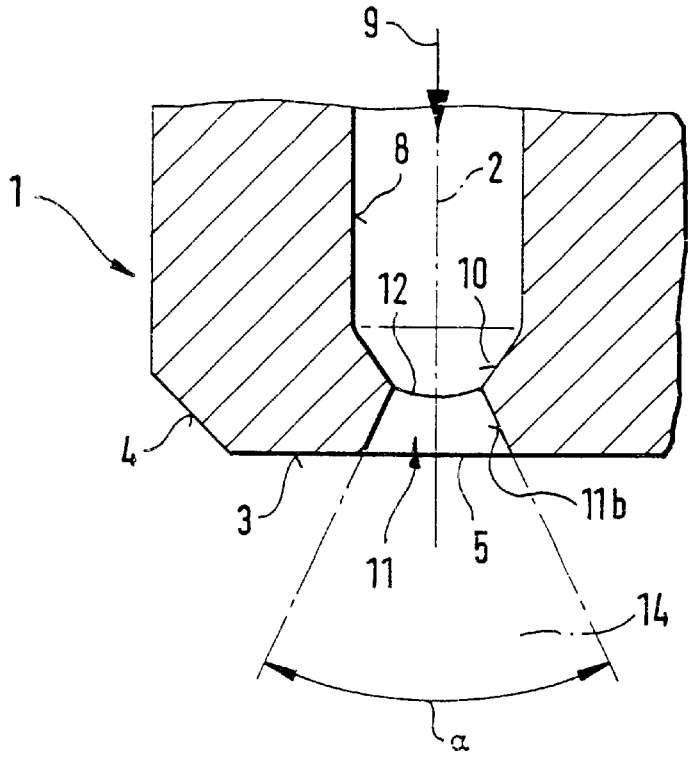
FIG. 3 is a view of a section through the nozzle body in FIG. 2 along section line III—III.
Figure 4:
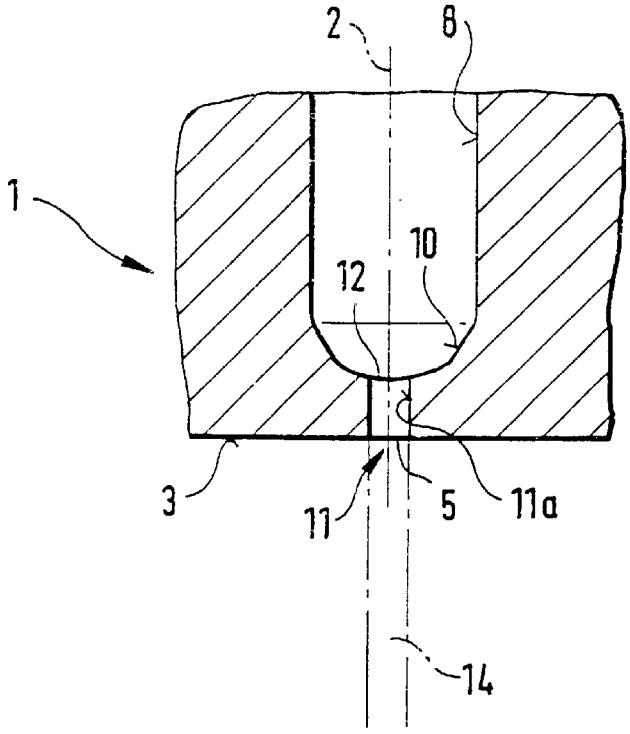
FIG. 4 is a view of the section along line IV—IV in FIG. 2.

As shown in the figures, and especially FIGS. 3 and 4, a cylindrical supply bore 8 for a fluid to be sprayed is provided inside cylindrical nozzle body 1. The bore tapers in the direction of end surface 3 and in the flow direction of the fluid to be sprayed, indicated by arrow 9, so as to form a spherical surface 10. This spherical surface 10 does not absolutely have to be spherical can also have other, similar, shapes such as, for example, the shape of a parabolic cross section. The surface outlet channel 11 leads to the opening 5 which diverges from an internal entrance opening 12 that has a smaller throughput cross section than the opening 5 and, therefore, which expands toward the end surface 3.

FIGS. 3 and 4 show that the outlet channel 11 expands only in the direction of the major semiaxis 6 of the two elliptical openings 12 and 5 but changes its cross section little if at all in the the direction of minor semiaxis 13. FIG. 4 shows the side walls 11*a*that abut minor semiaxis 13 as forming walls that run essentially parallel to axis 2 of the supply bore.

FIG. 3 on the other hand shows that the side walls 11*b* of outlet channel 11 located in the vicinity of the major semiaxis expand diagonally outward to the larger outlet opening 5. In the embodiment shown, these side walls 11*b* can be seen to be boundary surfaces that run straight in cross section (FIG. 3) and could, for example, be partial surfaces of a conical jacket having an elliptical bottom surface with an axis which coincides with the axis 2 of the supply bore 8.

However, as FIGS. 3 and 4 also show, the side walls 11*a* and 11*b* of outlet channel 11, in other words the side walls of the flow channel formed between the opening 12 and the opening 5, are designed as boundary surfaces so as to form the flat stream 14 as shown in FIGS. 3 and 4. This flat stream 14, therefore, can be limited and shaped in the manner desired. Its impact cross section remains defined and limited. Since the stream emerges at very high pressure from the nozzle body 1, its impact effect is much better, primarily in the direction of minor semiaxis 13 of the ellipses of the outlet openings 12 and 5, than is known in nozzles according to the prior art.

Nozzle body 1 can be made in known fashion from high-strength wear-resistant materials. Angle a of the flat stream 14 to be produced determines the inclination of the side wall parts 11*b* relative to axis 2.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

We claim:

1. High-pressure spray nozzle with a rotationally symmetrical nozzle body comprising a coaxial supply bore for fluid to be sprayed which tapers to an elliptical opening, said elliptical opening forming an entrance opening for an outlet channel that terminates in an elliptical outlet opening, with a larger cross section than that of said elliptical opening, located in a flat end surface of said nozzle body that is perpendicular to an axis of said nozzle body, wherein only areas of side walls of said outlet channel that abut a major semiaxis are expanded in the flow direction while side walls of said outlet channel that abut a minor semiaxis run essentially parallel to the axis of said supply bore so that essentially no change in a cross section of said outlet channel along said minor semiaxis is present.

2. High-pressure spray nozzle according to claim 1 wherein the side walls of said outlet channel that abut the major semiaxis are designed to run essentially parallel to boundary surfaces of an expanding fluid stream.

3. High-pressure spray nozzle according to claim 2 characterized in that the side walls of said outlet channel that abut the major semiaxis are partial surfaces of a conical jacket.

* * * * *